US005642785A

United States Patent [19]

Dam-Rasmussen

[11] Patent Number: 5,642,785

[45] Date of Patent: Jul. 1, 1997

[54] IMPLEMENT COUPLING FOR EXCAVATORS OR LOADERS

[76] Inventor: Kaj Dam-Rasmussen, Hoerhavevej 62 M, DK-8270 Hoejbjerg, Denmark

[21] Appl. No.: 537,800

[22] PCT Filed: Apr. 25, 1994

[86] PCT No.: PCT/DK94/00166

§ 371 Date: Oct. 25, 1995

§ 102(e) Date: Oct. 25, 1995

[87] PCT Pub. No.: WO94/25689

PCT Pub. Date: Nov. 10, 1994

[30] Foreign Application Priority Data

Apr. 26, 1993 [DK] Denmark ..... 0473/93

[51] Int. Cl.[6] ..... A01B 71/00; E02F 3/00; E02F 3/96

[52] U.S. Cl. ..... 172/272; 172/273; 172/275; 414/723

[58] Field of Search ..... 414/723, 686, 414/687, 694; 172/272, 273, 274, 275; 37/347, 379, 264, 468; 403/322, 325

[56] References Cited

U.S. PATENT DOCUMENTS

| | | | |
|---|---|---|---|
| 3,985,249 | 10/1976 | Aker et al. | 172/275 X |
| 4,067,467 | 1/1978 | Datta et al. | 172/275 X |
| 4,203,238 | 5/1980 | Bangert et al. | 172/272 X |
| 5,332,353 | 7/1994 | Arnold | 172/275 X |
| 5,382,110 | 1/1995 | Perotto et al. | 172/272 X |
| 5,415,235 | 5/1995 | Gebauer | 172/272 X |

*Primary Examiner*—Terry Lee Melius
*Assistant Examiner*—Robert Pezzuto
*Attorney, Agent, or Firm*—Antonelli, Terry, Stout & Kraus, LLP

[57] ABSTRACT

A mechanism for coupling an implement to an arm. The mechanism includes a coupling mechanism for attachment to the arm; a locking mechanism which is part of the implement; a splice which is movable relative to the implement between a forward locking position which engages the locking mechanism to prevent disconnection of the implement from the arm and a rear position permitting disconnection of the implement from the arm; and a pivotable swinging mechanism coupled to the locking splice and pivoted about a first pivot axle for moving the splice between the forward and rear positions, the pivotable swinging mechanism comprising a first member coupled to the splice and to a second pivot axle carried by the pivotable swinging mechanism at a distance spaced from the first axle and a second member which is rotatable into a position substantially parallel to the first member having an end part for preventing movement of the splice from the forward position to the rear position so as to position the splice in the forward locking position.

20 Claims, 1 Drawing Sheet

IMPLEMENT COUPLING FOR EXCAVATORS OR LOADERS

BACKGROUND OF THE INVENTION

1. Field of the Invention

The present invention relates to an implement coupling for excavators or loaders.

2. Description of the Prior Art

Implement couplings of this type are used to shift quickly and easily between different implements, for instance between excavator buckets with different widths or between excavator and loader buckets. The implement coupling may comprise an either manually operated shift mechanism requiring that the operator leaves the vehicle cabin, or a remote controlled shift mechanism, which may be operated from the cabin, for instance by means of a hydraulic hand pump.

At both manually and hydraulically operated implement couplings good security is required against failure and/or mis-operating of the locking function of the shift mechanism of the implement coupling.

SUMMARY OF THE INVENTION

The invention provides loaders and which by simple provisions makes it possible to obtain extraordinarily good security against unintended disengagement of the implement.

The implement coupling according to the invention is distinctive in that the swing arm mechanism, opposite the locking splice, comprises a basic joint pivotally arranged on a central, fixed pivot axle, and the basic joint via a bent axle at a distance from the pivot axle being pivotally connected with the locking splice by means of an intermediate arm. The basic joint has a projecting arm part, which swings into a position mainly parallel with the intermediate arm, so that an end part of the projecting arm part is placed behind the locking splice, when in locked engagement with the hook-shaped locking part of the implement, and when the bent axle is placed in a dead center position at the opposite side of the connecting line between the locking splice. The pivot axle, and that the basic joint for operating of the shift mechanism furthermore are connected with a manual operating handle and/or a hydraulic activiation cylinder. By simple technical provisions extraordinarily good security against unintended disengagememt of the implement by releasing the locking function of the coupling is hereby obtained. Appropriately the implement coupling according to the invention is such provided with a pressure cylinder with a piston rod, a piston and a powerful pressure spring inserted in the intermediate arm.

When the implement coupling according to invention manually operated, it appropriately may be such provided with the operating handle being connected with the projected arm part at the side opposite the intermediate arm, and the operating handle has a pivoting locking pawl for locking the operating handle, when it is swung in parallel with the intermediate arm, in the locking position of the implement coupling.

The implement coupling according to the invention, when hydraulically operated, advantageously may be provided with a piston rod of the hydraulic activation cylinder connected with an activiation arm part of the basic joint projecting from the latter opposite the projecting arm part. That side opposite of the intermediate arm by means of the end part engages behind the locking splice when the activation arm part is led to the rear by the piston rod. The hydraulic activation cylinder is provided with an internal pressure spring affecting the piston rod in the direction towards the activation arm part that is maintaining the locking function of the implement coupling if the hydraulic pressure should disappear.

BRIEF DESCRIPTION OF THE DRAWINGS

The invention is explained in more detail in the following with reference to the drawing, in which:

FIG. 1 shows a plane partial view, seen from above of an embodiment for an implement coupling according to the invention; while

DESCRIPTION OF THE PREFERRED EMBODIMENTS

Figure 1:
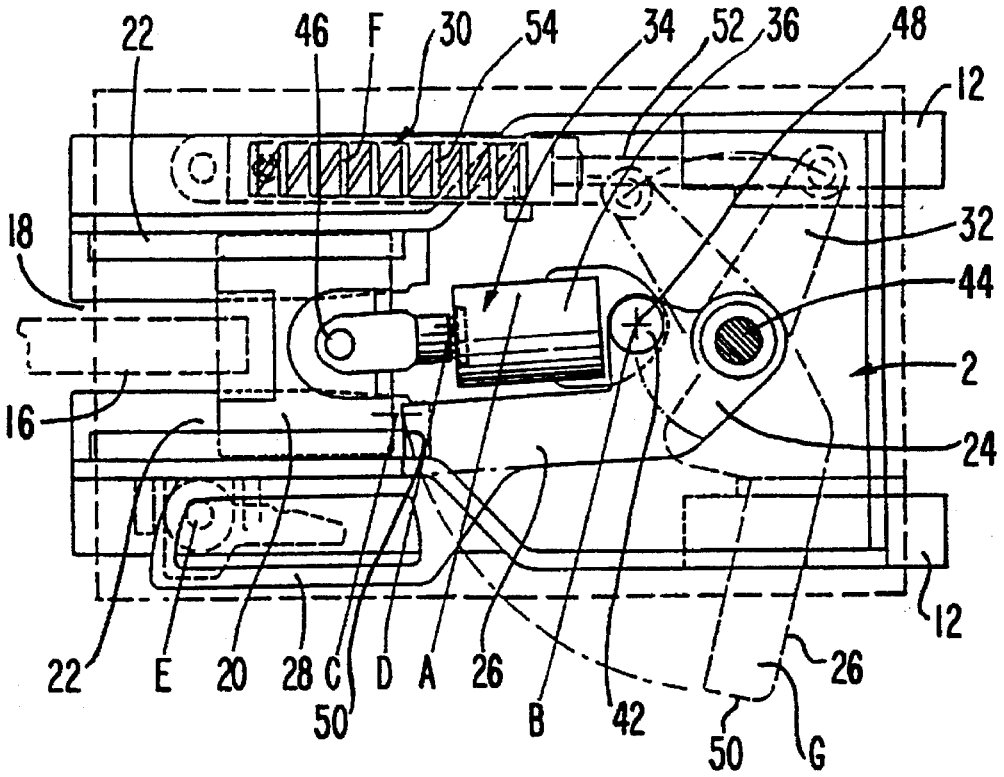
Figure 2:
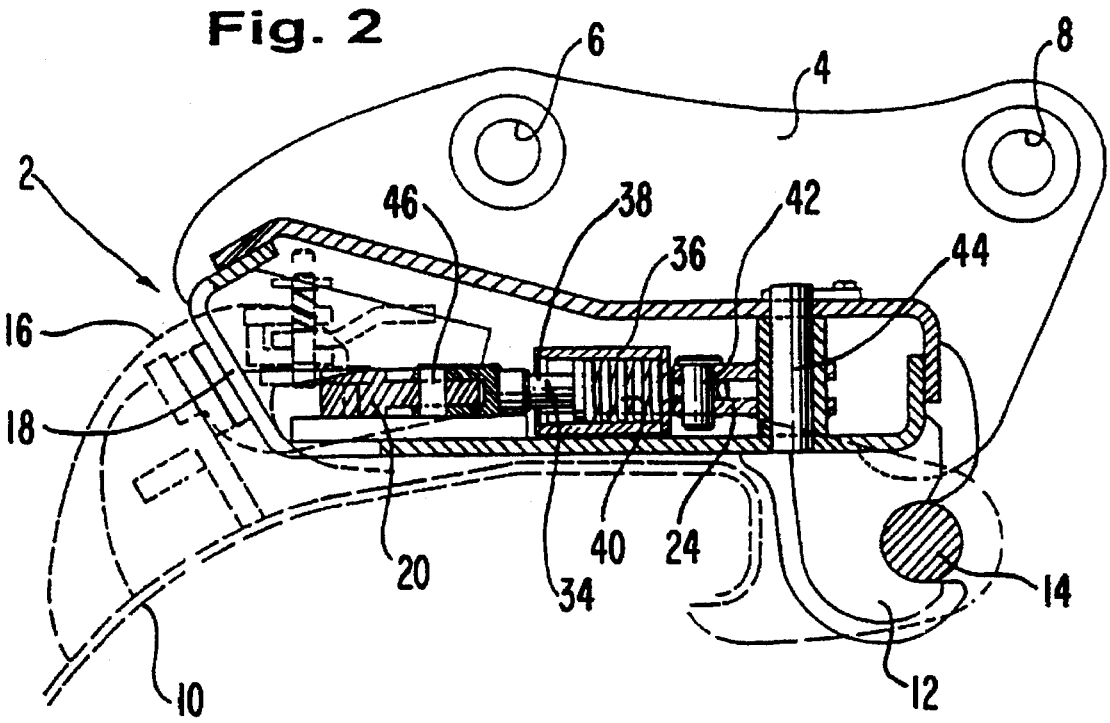
FIG. 2 shows a side view, partly in section of the implement coupling shown in FIG. 1.

The implement coupling 2, as illustrated in FIGS. 1 and 2, comprises two parallel bearing plates 4 with bearings 6 and 8 by means of which the implement coupling 2 is intended to be mounted at an outer end of an excavator arm or a loader arm respectively to be connected with a yoke of a hydraulic cylinder for swinging of the implement coupling, for instance an excavator bucket or a loader bucket 10 (FIG. 2). The implement coupling 2 is at an end provided with hook-shaped connecting parts 12 for grasping fixed connecting dowels 14 at each side of the implement, for instance the excavator bucket 10. The opposite side is provided with a hook-shaped locking part 16, which extends into the implement coupling 2 through a central side opening 18.

When the connecting parts 12 are positioned over the connecting dowels 14, the hook-shaped locking part is extends through the central side opening 18 and a locking splice 20, which is displacable arranged between gliding rails 22 of the implement coupling 2, extends forward into a locked position with the hook-shaped locking part 16, which is carried out by swinging a basic joint 24 either manually by means of a projecting arm part 26 and an operating handle 28 or hydraulically by means of an activation cylinder 30 and an activation arm part 32, so that the locking splice 20 may be moved forward by means of an intermediate arm 34.

The intermediate arm 34, which comprises a pressure cylinder 36 with a piston rod 38 and a large pressure spring 40, is inserted between the locking splice 20 and a bent axle 42 of the basic joint 24. The bent axle 42 is placed at a distance from a fixed pivot axle 44 for the basic joint 24, so that the springy intermediate arm 34 may be displaced inwards passing the direct connecting line between the pivot axle 44 and a turning point 46 between the locking splice 20 and the intermediate arm 34 to a dead center position 48, where and end part 50 of the projecting arm part 26 is swung further inwards to a position just behind the locking splice 20. This provides extraordinary security that the unintended locking splice 20 may not be moved out of the locking engagement with the hook-shaped locking part 16.

The hydraulic activation cylinder 30 may appropriately be placed at the opposite side of the implement coupling 2, so that the activiation cylinder 30 by means of a pistion rod 52 may move the activation arm part 32 with that the basic joint 24 for releasing the locking engagement being the locking splice 20 and the locking part 16. Also in this situation the displaced bent axle 42 is used for establishment of a selflocking dead center position, with high security that unintended disengagement of the locking engagement between the locking splice 20 and the locking part 16 by means of the projecting arm part 26 does not occur, of which arm part an end part is placed just behind the locking splice 20. The activation cylinder 30 is further provided with an internal pressure spring 54, which biases the piston rod 52 in the direction towards the activation arm part 32, and which thereby assists to maintain the locking function of the implement coupling, if the hydraulic pressure should disappear.

Regardless if the implement coupling according to the invention is adapted to be manually or hydraulically operated, high good security against unintended disengagement of the locking engagement between the locking splice 20 and the locking part 16 is obtained, namely because of the following:

Manual:

A: Intermediate arm 34 comprises pressure cylinder 36

B: Intermediate arm 34 fixed in dead center position 48

C: End part 50 of projecting arm part 26 placed behind the locking splice 20

D: Short free length of stroke of the pressure cylinder 36

E: Operating handle 28 locked in locking position.

Hydraulic:

A: Intermediate arm 34 comprises pressure cylinder 36

B: Intermediate arm 34 fixed in dead center position 48

C: End part 50 of projecting arm part 26 placed behind the locking splice 20

F: Activation cylinder 30 comprises pressure spring 54

G: Projecting arm part 26 functions as signal marker

I claim:

1. A mechanism for coupling an implement to an arm comprising:

a coupling mechanism for attachment to the arm;

a locking mechanism which is part of the implement;

a splice which is movable relative to the implement between a forward locking position which engages the locking mechanism to prevent disconnection of the implement from the arm and a rear position permitting disconnection of the implement from the arm; and a pivotable swinging mechanism coupled to the locking splice and pivoted about a first pivot axle for moving the splice between the forward and rear positions, the pivotable swinging mechanism comprising a first member coupled to the splice and to a second pivot axle carried by the pivotable swinging mechanism at a distance spaced from the first axle and a second member which is rotatable into a position substantially parallel to the first member having an end part for preventing movement of the splice from the forward position to the rear position so as to position the splice in the forward locking position.

2. A mechanism in accordance with claim 1 wherein the locking mechanism is a hook-shaped locking part.

3. A mechanism in accordance with claim 1 wherein:

the second axle is a bent axle which pivots and has a dead center position at which the second axle is positioned when the second member is rotated into the position substantially parallel to the first member.

4. A mechanism in accordance with claim 2 wherein:

the second axle is a bent axle which pivots and has a dead center position at which the second axle is positioned when the second member is rotated into the position substantially parallel to the first member.

5. A mechanism in accordance with claim 1 further comprising:

a cylinder having a piston rod and a spring for biasing the piston rod into an extended position; and wherein the piston rod is coupled to the second member for biasing the second member into the position substantially parallel to the first member.

6. A mechanism in accordance with claim 5 wherein:

the second member is pivoted about the first axle and has first and second ends which are spaced from the first axle with the first end being the first end part and the second end being attached to the piston rod.

7. A mechanism in accordance with claim 2 further comprising:

a cylinder having a piston rod and a spring for biasing the piston rod into an extended position; and wherein the piston rod is coupled to the second member for biasing the second member into the position substantially parallel to the first member.

8. A mechanism in accordance with claim 7 wherein:

the second member is pivoted about the first axle and has first and second ends which are spaced from the first axle with the first end being the first end part and the second end being attached to the piston rod.

9. A mechanism in accordance with claim 3 further comprising:

a cylinder having a piston rod and a spring for biasing the piston rod into an extended position; and wherein the piston rod is coupled to the second member for biasing the second member into the position substantially parallel to the first member.

10. A mechanism in accordance with claim 9 wherein:

the second member is pivoted about the first axle and has first and second ends which are spaced from the first axle with the first end being the first end part and the second end being attached to the piston rod.

11. A mechanism in accordance with claim 4 further comprising:

a cylinder having a piston rod and a spring for biasing the piston rod into an extended position; and wherein the piston rod is coupled to the second member for biasing the second member into the position substantially parallel to the first member.

12. A mechanism in accordance with claim 11 wherein:

the second member is pivoted about the first axle and has first and second ends which are spaced from the first axle with the first end being the first end part and the second end being attached to the piston rod.

13. A mechanism in accordance with claim 1 further comprising:

a hydraulically operated cylinder having an extension for holding the second member in the position substantially parallel to the first member.

14. A mechanism in accordance with claim 13 wherein:

the second member is pivoted about the first axle and has first and second ends which are spaced from the first axle with the first end being the first end part and the second end being attached to the extension.

15. A mechanism in accordance with claim 2 further comprising:

a hydraulically operated cylinder having an extension for holding the second member in the position substantially parallel to the first member.

16. A mechanism in accordance with claim 15 wherein:

the second member is pivoted about the first axle and has first and second ends which are spaced from the first axle with the first end being the first end part and the second end being attached to the extension.

17. A mechanism in accordance with claim 3 further comprising:

a hydraulically operated cylinder having an extension for holding the second member in the position substantially parallel to the first member.

18. A mechanism in accordance with claim 17 wherein:

the second member is pivoted about the first axle and has first and second ends which are spaced from the first axle with the first end being the first end part and the second end being attached to the extension.

19. A mechanism in accordance with claim 4 furyher comprising:

a hydraulically operated cylinder having an extension for holding the second member in the position substantially parallel to the first member.

20. A mechanism in accordance with claim 19 wherein:

the second member is pivoted about the first axle and has first and second ends which are spaced from the first axle with the first end being the first end part and the second end being attached to the extension.

* * * * *